US005716773A

United States Patent [19]

Nairne et al.

[11] Patent Number: 5,716,773

[45] Date of Patent: Feb. 10, 1998

[54] ALTERATION OF IMAGE TONE IN BLACK AND WHITE PHOTOGRAPHIC MATERIALS

[75] Inventors: Robert James Domett Nairne, Bishop's Stortford; Julian Mark Wallis, Harlow Essex, both of England; Alexis Sarah Zinn-Warner, Maplewood, Minn.

[73] Assignee: Minnesota Mining and Manufacturing Company, St. Paul, Minn.

[21] Appl. No.: 661,264

[22] Filed: Jun. 10, 1996

[30] Foreign Application Priority Data

Jun. 23, 1995 [GB] United Kingdom ..... 9512899

[51] Int. Cl.[6] ..... G03C 1/005

[52] U.S. Cl. ..... 430/565; 430/356; 430/600; 430/603

[58] Field of Search ..... 430/600, 603, 430/565, 569, 944, 356

[56] References Cited

U.S. PATENT DOCUMENTS

| | | |
|---|---|---|
| 3,615,615 | 10/1971 | Lincoln et al. . |
| 4,396,711 | 8/1983 | Overman . |
| 5,204,213 | 4/1993 | Okada et al. . |
| 5,314,790 | 5/1994 | Hershey et al. . |

FOREIGN PATENT DOCUMENTS

| | | |
|---|---|---|
| 1147697 | 4/1969 | United Kingdom . |
| 1319548 | 6/1973 | United Kingdom . |
| 1342149 | 12/1973 | United Kingdom . |
| 1367417 | 9/1974 | United Kingdom . |
| 1457818 | 12/1976 | United Kingdom . |
| 1458197 | 12/1976 | United Kingdom . |
| 1518850 | 7/1978 | United Kingdom . |
| 2034495 | 6/1980 | United Kingdom . |
| 2116976 | 10/1983 | United Kingdom . |

*Primary Examiner*—Thorl Chea

*Attorney, Agent, or Firm*—Walter N. Kirn; Gregory Evearitt; Arlene K. Musser

[57] ABSTRACT

Blue-black color favored in medical imaging is imparted to black and white photographic emulsions by the addition of a compound of formula I or II:

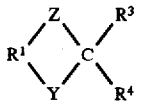

I

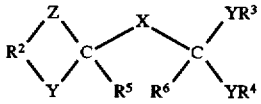

II wherein:

$R^1$ and $R^2$ independently represent one or more carbon atoms necessary to complete a 5, 6 or 7 membered ring;

$R^3$ and $R^4$ independently represent H, alkyl or aryl groups or together represent the atoms selected from C, N, O and S necessary to complete a 5, 6 or 7 membered cyclic ring but are not both H;

$R^5$ and $R^6$ independently represent H or alkyl or together represent the atoms selected from C, N, O and S necessary to complete a 5, 6 or 7 membered ring;

X represents a bond or a divalent linking group, each Y may be the same or different and is selected from S, Se, O, and $NR^7$, where $R^7$ is H or alkyl of up to 5 carbon atoms, and Z is S or Se.

18 Claims, No Drawings

ALTERATION OF IMAGE TONE IN BLACK AND WHITE PHOTOGRAPHIC MATERIALS

FIELD OF THE INVENTION

This invention relates to black-and-white silver halide photographic materials and to compounds for imparting a blue-black colour to the image formed in such materials.

BACKGROUND TO THE INVENTION

It is desirable to control the colour or tone of images produced in black-and-white films. In certain applications such as medical applications where diagnoses are made from black-and-white films, the medical profession has a preference for blue-black tones in the silver images. The colour of a silver image is affected by many factors including grain composition, grain morphology, grain size and the developers used. To design photographic emulsions with better performance in areas other than image tone, such as resolution and developability, these factors may be altered. These alterations may bring about an undesirable change in tone, for example, producing brown images which are not favoured by medical practitioners. It is therefore desirable to remove some of the limitations imposed by the requirements of the image tone, to optimize the performance of the emulsions.

A number of different approaches to overcome silver image colour and tone problems have been suggested.

U.S. Pat. No. 4,818,675 and JP 03153234 disclose the use of blue leuco dyes to mask the warm image tone by imagewise production of a blue dye. Other prior art describes the use of heterocyclic thiols or thiones, (JP 61020026 and JP 63015140). EP 0197895 discloses the use of 2-alkylthiotetraazaindenes as image toners in black and white paper products. Other silver co-ordinating species described include macrocylic sulphides of compounds containing at least 3 sulphur atoms, at least one carbon chain and at least one other divalent linking group (JP63313939). Blue dyes used in the emulsion layer to alter the visual impression of the image colour are disclosed in EP 0481651 and JP 03271733.

Disadvantages of all these approaches are that they can lead to loss of speed and/or increase the optical density of film in unexposed regions.

Cyclic compounds having sulphur atoms in the ring have been incorporated in photographic emulsions as disclosed in GB1342149 and GB1147697 for purposes, such as sensitization.

BRIEF SUMMARY OF THE INVENTION

According to the present invention there is provided a silver halide photographic material comprising a compound of general formula I or II:

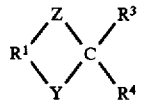

I

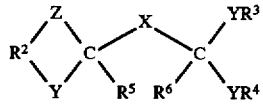

II wherein:

$R^1$ and $R^2$ independently represent the carbon atoms necessary to complete a 5, 6 or 7 membered ring;

$R^3$ and $R^4$ independently represent H, alkyl or aryl groups or together represent the atoms selected from C, N, O and S necessary to complete a 5, 6 or 7 membered ring (but are not both H);

$R^5$ and $R^6$ independently represent H or alkyl or together represent the atoms selected from C, N, O and S necessary to complete a 5, 6 or 7 membered ring; and X represents a bond or a divalent linking group, preferably an alkylene group (e.g., methylene or ethylene group) and more preferably $—CH_2—$ or $—C_2H_4—$;

each Y may be the same or different and is selected from O, $NR^7$ (where $R^7$ is H or alkyl of up to 5 carbon atoms), S, or Se;

and Z is S or Se, with the proviso that when $R^1$ is $—CH_2CH_2—$ and $R^3$ and $R^4$ together complete a spiro-cyclohexyl group, Y is other than O.

DESCRIPTION OF PREFERRED EMBODIMENTS

Preferably, Y is selected from S or O and Z is S. In preferred embodiments $R^1$ and $R^2$ comprise 2 or 3 carbon atoms to complete five or six-membered saturated rings.

Preferred compounds also include those in which $R^3$ and $R^4$ together comprise the carbon atoms necessary to complete a five or six-membered saturated ring. Preferably, $R^5$ and $R^6$ represent H, or together comprise the carbon atoms necessary to complete a 5 or 6 membered saturated rings.

Preferred compounds in accordance with the invention comprise single ring or preferably double ring structures selected from the list consisting of 1,3-dithiane, 1,3-dithiolane, 1,3-thioxane and 1,3-thioxolane. Compounds comprising a single ring selected from the said list are preferably disubstituted at the 2-position, e.g., by alkyl and/or aryl groups, or more preferably by a spiro-cycloaliphatic group such as spiro-cyclohexyl or spiro-cyclopentyl. In compounds comprising two rings selected from the said list, the 2-positions of said rings are linked by a covalent bond, a divalent linking group or a spiro-cycloaliphatic linking group. Suitable divalent linking groups include alkylene groups of up to 4 (preferably up to 2) carbon atoms such as methylene and ethylene, and suitable spiro-cycloaliphatic linking groups are groups such as (bis-spiro) cyclohexane-1,4-diyl and (bis-spiro) cyclohexane-1,3-diyl. Any or all of the rings and linking groups described above may bear additional substituents.

As is well understood in this technical area, a large degree of substitution is not only tolerated, but is often advisable. As a means of simplifying the discussion, the terms "nucleus", "groups" and "moiety" are used to differentiate between chemical species that allow for substitution or which may be substituted and those which do not or may not be so substituted. For example, the phrase "alkyl group" is intended to include not only pure hydrocarbon alkyl chains, such as methyl, ethyl, octyl, cyclohexyl, iso-octyl, t-butyl and the like, but also alkyl chains bearing conventional substituents known in the art, such as hydroxyl, alkoxy, phenyl, halogen (F, Cl, Br and I), cyano, nitro, amino etc. The term "nucleus" is likewise considered to allow for substitution. The phrase "alkyl moiety" on the other hand is limited to the inclusion of only pure hydrocarbon alkyl chains, such as methyl, ethyl, propyl, cyclohexyl, iso-octyl, t-butyl etc.

However, in choosing substituents it is advisable to consider the mode of action of these compounds. While the precise mode of action is not fully understood, it is postulated that the compounds of the invention adsorb on the silver halide grains and influence the physical morphology of the silver metal produced in the development process. Hence the water solubility of the compounds is important. Too high a solubility may inhibit adsorption on the grain surface, while too low a solubility in water or aqueous-organic mixtures may render the compounds unusable. Consequently, strongly hydrophobic groups such as long alkyl chains (e.g., of 5 or more carbon atoms), aryl groups, perfluoroalkyl groups etc., are not preferred, unless balanced by strongly hydrophilic groups such as acid anions, quaternary ammonium cations, polyoxyalkylene chains etc. If substituents are present, they are preferably selected from small, neutral or weakly polar groups such as lower alkyl, alkoxy, alkylthio, carboxylic acid (and esters and amides thereof), aldehyde or ketone groups (all of less than 5 carbon atoms), halogen atoms, hydroxyl groups, thiol groups and nitrile groups. Steric hindrance must also be considered, and so bulky groups which might hinder adsorption on the grain surface are not preferred.

The present invention utilises readily prepared compounds which, when incorporated into silver halide containing emulsions, impart blue-black colour to the image formed therefrom without significant impact on sensitometric properties of the film, e.g., photographic speed, contrast, Dmin and Dmax. Moreover, this effect is also observed when films are developed through different developer chemistries. The synthesis of the molecules is simple and in most cases can be carried out in one step from readily available starting materials using well known synthetic methodology.

A wide range of silver halide emulsions may be used, including pure silver chloride or silver bromide, as well as mixed halide compositions such as silver chlorobromide, silver iodochloride or silver chloroiodobromide emulsions. The silver halide grains may be of a uniform or layered composition. Preferred emulsions are uniform chlorobromide emulsions where the mol fraction of chloride in the grains is at least 50%.

The morphology of the silver halide grains is typically, but not limited to the cubic habit. However, octahedral, tetrahedral, rhombododecahedral, icosatetrahedral, tabular or laminar grains, as well as mixtures of these shapes may be employed. Grains of less well defined shape and with epitaxial features are also envisaged.

The mean edge length of at least 50% of the grains by number is generally less than 2.0 microns, preferably less than 1.0 micron. Especially preferred are grains of mean edge length less than 0.4 microns down to about 0.01 micron.

The emulsion can be prepared, washed, chemically and spectrally sensitised by the techniques well known to those skilled in the Art. In particular, additives such as metal ions can be used to improve reciprocity behaviour, or to further enhance contrast, such as the ions of rhodium, ruthenium and/or iridium. The compounds of the invention may be added at any time during the preparation, such as before grain precipitation, after or during the growth of the grains, before or after chemical or spectral sensitisation. Typically the compounds are added just before the coating of the emulsion layers.

Preferably the toner compounds essential to the practice of the present invention are incorporated into the emulsion at levels of between 0.001 and 10 g/mol Ag; especially preferred are levels 0.001 and 2 g/mol Ag. Any suitable solvent may be used to dissolve the compound, e.g., water, methanol, ethanol, acetone, DMF.

The emulsion is spectrally sensitised using a dye which will enhance the sensitivity of the silver halide grains to the wavelength of the exposing device. For example, where a helium-neon laser is the output device, the emulsion is spectrally sensitised to 633 nm. Where an infrared laser diode is the output device, the emulsion can be sensitised, for example, in the region 750–900 nm. The emulsion can be suitable for continuous tone or half-tone image reproduction.

The invention is hereinafter described in more detail by way of example only. Examples of compounds suitable for use in this invention are as follows:

1

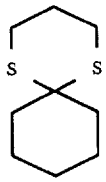

2

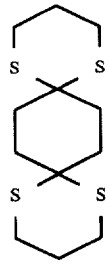

3

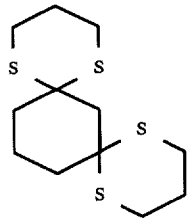

4

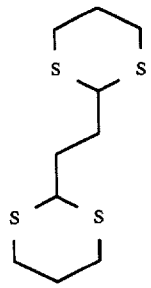

5

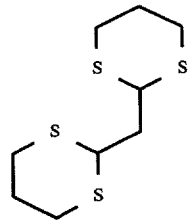

-continued

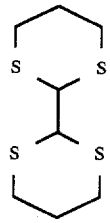

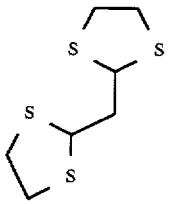

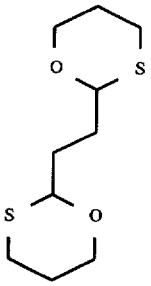

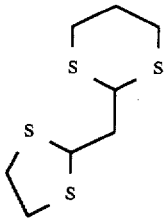

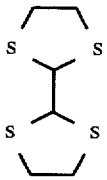

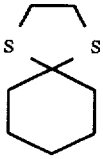

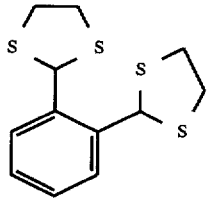

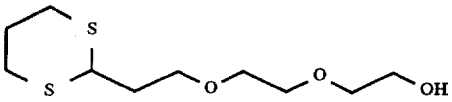

Synthesis of Compound 1

Cyclohexanone (3.93 g, 40 mmol) and 1,3-propanedithiol (4.87 g, 45 mmol) in dry dioxan (50 ml) were treated with anhydrous sodium sulfate (3.63 g, 30 mmol) and anhydrous zinc chloride (2.68 g, 20 mmol) under an atmosphere of nitrogen. The mixture was stirred at room temperature for 48 hours before being added to water (250 ml). The mixture was extracted with ether (3×200 ml), the combined extracts were washed with water (3×250 ml), dried ($MgSO_4$), filtered and evaporated to give a colourless oil which crystallised on standing. The solid was chromatographed over silica gel 60 (5% ether in petrol) and then crystallised from ethanol to give 1.5 g of the desired product.

Synthesis of Compound 2

Cyclohexane-1,4-dione (2.86 g, 26 mmol) and 1,3-propanedithiol (7.02 g, 65 mmol) in dichloromethane (100 ml) were treated with boron trifluoride etherate (1 ml) with ice-cooling. The reaction mixture was stirred at room temperature for 4 hours before 2M sodium hydroxide solution (100 ml) was added. The organics were separated, dried, filtered and evaporated to give a colourless solid which was washed with ethanol (500 ml) and dried in vacuo to give 5.14 g (68%) of the desired product.

Synthesis of Compound 3

A solution of 1,3-cyclohexanedione (2.86 g, 26 mmol) and 1,3-propanedithiol (7.02 g, 65 mmol) in dichloromethane (100 ml) was treated with boron trifluoride etherate (1 ml) with ice-cooling. The mixture was stirred at room temperature for 24 hours. 2M sodium hydroxide solution (100 ml) was added to the mixture and the organics were separated, dried, filtered and evaporated to give solid which was washed with ethanol (500 ml) and dried in vacuo to give 5.92 g (78%) of the desired product as a colourless solid.

Synthesis of Compound 4

Boron trifluoride etherate (4 ml) was added to a stirred solution of 2,5-dimethoxytetrahydrofuran (2.64 g, 20 mmol) and 1,3-propanedithiol (5.4 g, 50 mmol) in chloroform (100 ml). The mixture was stirred at room temperature for 2 hours before 2M sodium hydroxide solution (100 ml) was added. The layers were separated and the organics were washed with water, dried, filtered and evaporated to give a colourless solid which was washed with methanol (500 ml), then recrystallised from chloroform/methanol to give 2.1 g (39%) of the desired compound as a colourless solid.

Synthesis of Compound 5

This compound was prepared according to the synthesis described by Alberts and Cram (J. Amer. Chem. Soc., 1979, 3545) to give 4.3 g (67%) of the desired compound.

Synthesis of Compound 6

Glyoxaltrimer dihydrate (2.1 g, 10 mmol) was suspended in dichloromethane (50 ml) under nitrogen. 1,3-Propanedithiol (7.56 g, 70 mmol), acetic acid (5 ml) and boron trifluoride etherate (4 ml) were added and the mixture was heated at reflux until the mixture became clear. The mixture was allowed to cool to room temperature and then 2M sodium hydroxide (50 ml) was added. The organics were separated, dried, filtered and evaporated to give a colourless solid which was washed with methanol (500 ml) and dried in vacuo to give 3.8 g (53%) of a colourless solid.

Synthesis of Compound 7

This compound was prepared in an analogous manner to compound 5 using 1,2-ethanedlthiol in place of 1,3-propanedithiol to give 2.97 g (55%) of the desired product as a colourless solid.

Emulsions Used in this Invention

Preparations of Emulsion A

A cubic silver halide emulsion of mean grain diameter 0.10 micron and of uniform halide composition 90 mol % silver chloride, 10 mol % silver bromide was prepared by a conventional double-jet precipitation procedure, as is well-known to those skilled in the Art. 2.46M silver nitrate solution (3.30 mol) and a potassium halide solution of the appropriate composition were pumped into an aqueous gelatin solution at a constant pump rate at 30° C. over 25 minutes with high speed stirring. The soluble salt by-products were removed by precipitation of the phthalated gelatin at low pH, followed by reconstitution and addition of more gelatin to a level of 85 g/mol Ag. Before coating, the emulsion was chemically sensitised using sodium thiosulphate and gold chloride and spectrally sensitized in the infrared region of the spectrum using a mixture of two heptamethine cyanine dyes.

Preparation of Emulsion B

A cubic 0.1 micron pure silver chloride emulsion was prepared by balanced double-jet precipitation of 2.50M potassium chloride and 2.50M silver nitrate solutions at 36° C. The resulting emulsion was chemically sensitised using sodium thiosulphate and gold chloride and spectrally sensitised using a pair of infrared absorbing merocyanine dyes.

Preparation of Emulsion C

A pure silver bromide emulsion, of mean grain size 0.11 micron was prepared. A kettle solution consisting of 7.7% gelatin, pH=3.0 and pBr=3.05 at 40° C. was prepared. Solutions of silver nitrate (3.84M) and potassium bromide (3.98M) were used to nucleate a seed population (10 ml of each solution over 7 seconds), and after 3 minutes the silver and bromide solutions were added under pAg controlled conditions at a linearly increasing rate, such that 4.232 mol silver nitrate was added over 38 minutes. The total silver precipitate was thus 4.27 mol.

Addition of Toning Agents to Emulsions

The toning agents were added to the emulsions as approximately 5% solutions in dimethylformamide just before coating. The emulsions were coated at a nominal coating weight of 1.7 g/m$^2$Ag, and subjected to a heat treatment (16 hr, 38° C.) before evaluation. For sensitometric evaluation, strips of film were exposed by a white light source via a 4.0 density continuous wedge and a 800 nm broad band filter. For tone measurement strips of film were similarly exposed through a 3.0-density step wedge. All samples were developed in either (a) 3MXAD3 developer at 34° C. for 25 seconds in an Autopan Contimat 230 processor, or (b) Kodak RP X-OMat developer at 34° C. for 25 seconds in the Autopan 230 processor.

Measurement of Image Tone

The image tone of the exposed film was measured using CIE colour coordinates at optical densities of between 0.85 and 1.15. The coordinate associated with the blueness is the b* coordinate. The more positive the number, the more yellow the image tone and therefore the more negative the value for b* the more blue the colour. A significant difference in b* value (detectable by the human eye) is 1 unit. The Compounds exemplified herein impart a change in b* of 1 or greater towards a more negative value, i.e., Δb* takes negative values of 1 or more, Δb* being defined by the equation:

$$\Delta b^* = b^*_1 - b^*_o$$

where $b^*_1$ is the b* value of the film containing the additive measured at an optical density of between 0.85 and 1.15 and $b^*_o$ is the b* value of the film containing no additive measured at an optical density of between 0.85 and 1.15.

EXAMPLES

| Toner | Level mg/mol Ag | Emulsion | Δb* | Developer |
|---|---|---|---|---|
| 1 | 200 | B | −1.4 | RPX-Omat |
| | 500 | " | −1.3 | " |
| | 100 | " | −1.1 | 3M XAD3 |
| | 200 | " | −2.1 | " |
| | 500 | " | −4.5 | " |
| | 1000 | " | −5.2 | " |
| | 1000 | C | −2.3 | RPX-Omat |
| 2 | 200 | A | −3.7 | RPX-Omat |
| | 500 | " | −4.0 | " |
| | 1000 | " | −3.5 | " |
| | 2000 | " | −3.6 | " |
| 3 | 200 | B | −1.2 | RPX-Omat |
| | 500 | " | −3.6 | " |
| | 1000 | " | −5.7 | " |
| 3 | 20 | B | −1.0 | 3M XAD3 |
| | 50 | " | −1.5 | " |
| | 100 | " | −2.7 | " |
| | 200 | " | −3.9 | " |
| | 500 | " | −5.2 | " |
| | 1000 | " | −5.6 | " |
| | 100 | C | −2.4 | RPX-Omat |
| 4 | 200 | A | −2.5 | RPX-Omat |
| | 500 | " | −4.4 | " |
| | 500 | " | −3.0 | 3M XAD3 |
| | 1000 | " | −2.7 | " |
| 5 | 50 | A | −1.1 | RPX-Omat |
| | 100 | " | −1.7 | " |
| | 200 | " | −3.9 | " |
| | 100 | " | −1.8 | 3M XAD3 |
| | 200 | " | −2.0 | " |
| | 500 | " | −2.6 | " |
| | 200 | B | −2.1 | RPX-Omat |
| | 200 | " | −4.3 | 3M XAD3 |
| | 100 | C | −2.2 | RPX-Omat |
| 6 | 200 | A | −5.8 | RPX-Omat |
| | 500 | " | −8.2 | " |
| | 100 | " | −4.1 | 3M XAD3 |
| | 200 | " | −2.0 | " |
| | 500 | " | −2.8 | " |
| 7 | 20 | A | −1.8 | RPX-Omat |
| | 50 | " | −2.4 | " |
| | 100 | " | −3.3 | " |
| | 200 | " | −3.4 | " |
| 7 | 20 | A | −1.3 | 3M XAD3 |
| | 50 | " | −1.6 | " |
| | 100 | " | −1.7 | " |
| | 200 | " | −3.9 | " |
| | 200 | B | −4.2 | RPX-Omat |
| 8 | 100 | C | −1.1 | RPX-Omat |
| | 500 | " | −1.1 | " |
| 9 | 100 | C | −1.1 | RPX-Omat |

-continued

| Toner | Level mg/ mol Ag | Emulsion | Δb* | Developer |
|---|---|---|---|---|
| 10 | 100 | C | −1.4 | RPX-Omat |
| | 500 | " | −2.0 | " |
| | 1000 | " | −2.0 | " |
| 11 | 500 | C | −1.4 | RPX-Omat |
| | 1000 | " | −1.0 | " |

As can be seen from the above examples, the compounds of the present invention impart a change in b* of 1 or greater towards a more negative value, thus imparting a bluer tone.

What is claimed is:

1. A photographic emulsion layer comprising (a) a black-and-white negative-acting silver halide photographic emulsion containing silver halide grains and (b) a compound of formula I or II:

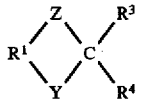

I

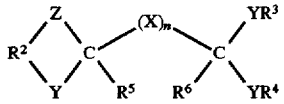

II wherein:

$R^1$ and $R^2$ independently represent one or more carbon atoms necessary to complete a 5, 6, or 7 membered ring;

$R^3$ and $R^4$ are members independently selected from the group consisting of H, alkyl and aryl groups or together represent the atoms selected from C, N, O and S necessary to complete a 5, 6 or 7 membered cyclic ring but are not both H;

$R^5$ and $R^6$ are members independently selected from the group consisting of H and alkyl or together represent the atoms selected from C, N, O and S necessary to complete a 5, 6 or 7 membered ring;

X is a divalent linking group;

n is 0 or 1;

each Y may be the same or different and is selected from the group consisting of O, S, and Se; and Z is S or Se, with the proviso that when $R^1$ is —$CH_2CH_2$— and $R^3$ and $R^4$ together complete a spiro-cyclohexyl group, Y is selected from the group consisting of S and Se.

2. The silver halide photographic layer according to claim 1 wherein said compound of formula I or II is present in the amount of between 0.001 and 2 g/mole Ag.

3. The silver halide photographic layer according to claim 1 wherein said material comprises a uniform chlorobromide emulsion wherein the mole fraction of chloride in said grains is at least 50%.

4. The silver halide photographic layer according to claim 1 wherein at least 50% by number of said silver halide grains in said emulsion have a mean edge length less than 2.0 microns.

5. The silver halide photographic layer according to claim 1 wherein said mean edge length is in the range of 0.4–0.01 microns.

6. The silver halide photographic layer according to claim 1 wherein Y is either S or O and Z is S.

7. The silver halide photographic layer according to claim 6 wherein $R^1$ comprises 2 or 3 carbon atoms to complete a 5 or 6 membered saturated ring, $R^3$ and $R^4$ together comprise the carbon atoms necessary to complete a five or six membered saturated ring, and $R^5$ and $R^6$ represent H, or together comprise the carbon atoms necessary to complete a 5 or 6 membered saturated ring.

8. The silver halide photographic layer according to claim 1 wherein said compound of formula I or II is a member selected from the group consisting of:

1

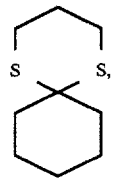

2

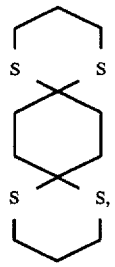

3

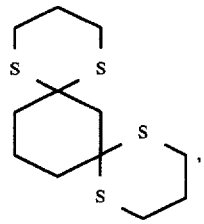

4

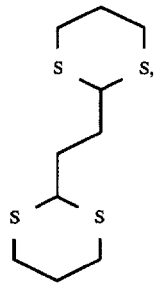

5

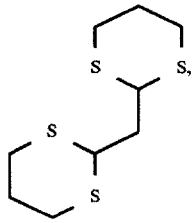

-continued

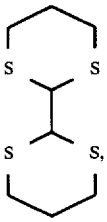

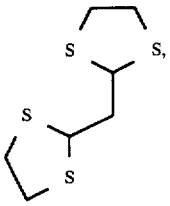

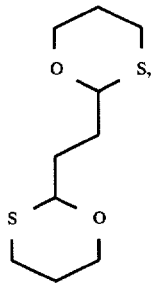

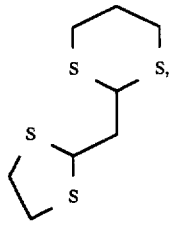

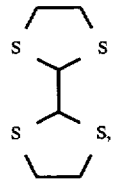

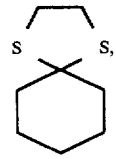

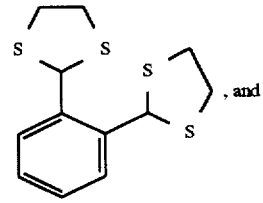

, and

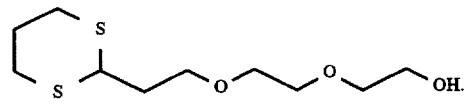

9. The silver halide photographic layer of claim 1 wherein said divalent linking group (X) is an alkylene group having 1 to 4 carbon atoms.

10. The silver halide photographic layer of claim 1 wherein said divalent linking group (X) is an alkylene group having 1 to 2 carbon atoms.

11. The silver halide photographic layer of claim 1 wherein said compound of formula I or II is present in the amount of between 0.001 and 10 g/mole Ag.

12. The silver halide photographic layer of claim 1 wherein said photographic emulsion is sensitized in the region of 750 to 900 nm.

13. A method for preparing a photographic black-and-white, negative-acting emulsion layer comprising (a) preparing a silver halide photographic emulsion containing silver halide grains;

(b) sensitizing said emulsion; and (c) adding a compound of formula I or II to said emulsion:

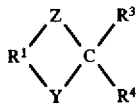

I

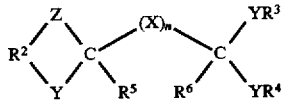

II wherein:

$R^1$ and $R^2$ independently represent one or more carbon atoms necessary to complete a 5, 6, or 7 membered ring;

$R^3$ and $R^4$ are members independently selected from the group consisting of H, alkyl and aryl groups or together represent the atoms selected from C, N, O and S necessary to complete a 5, 6 or 7 membered cyclic ring but are not both H;

$R^5$ and $R^6$ are members independently selected from the group consisting of H and alkyl or together represent the atoms selected from C, N, O and S necessary to complete a 5, 6 or 7 membered ring;

X is a divalent linking group;

n is 0or 1;

each Y may be the same or different and is selected from the group consisting of O, S, and Se; and Z is S or Se, with the proviso that when $R^1$ is —$CH_2CH_2$— and $R^3$ and $R^4$ together complete a spiro-cyclohexyl group, Y is selected from the group consisting of S and Se.

14. The method of claim 13 wherein said compound of formula I or II is present in the amount of between 0.001 and 10 g/mole Ag.

15. The method of claim 13 wherein said emulsion is a uniform chlorobromide emulsion wherein the mole fraction of chloride in said grains is at least 50%.

16. The method of claim 13 wherein at least 50% by number of said silver halide grains in said emulsion have a mean edge length less than 2.0 microns.

17. The method of claim 13 wherein said photographic emulsion is sensitized in step (b) to the region of 750 to 900 nm.

18. The method of claim 13 wherein said divalent linking group (X) is an alkylene group having 1 to 2 carbon atoms.

* * * * *